US011225753B2

(12) United States Patent
Naor et al.

(10) Patent No.: US 11,225,753 B2
(45) Date of Patent: Jan. 18, 2022

(54) DOMESTIC COMPACT ARTICLE FOLDING MACHINE HAVING HOLDING CONVEYORS AND FOLDING METHOD THEREFOR

(71) Applicants: Foldimate, Inc., Oak Park, CA (US); Gal Rozov, Ma'abarot (IL)

(72) Inventors: Isaac Naor, Ma'abarot (IL); Gal Rozov, Ma'abarot (IL); Alon Naim, Ma'abarot (IL); Avraham Avi Aspler, Ma'abarot (IL)

(73) Assignee: Foldimate, Inc., Oak Park, CA (US)

( * ) Notice: Subject to any disclaimer, the term of this patent is extended or adjusted under 35 U.S.C. 154(b) by 66 days.

(21) Appl. No.: 16/641,682

(22) PCT Filed: Aug. 9, 2018

(86) PCT No.: PCT/IL2018/050887
§ 371 (c)(1),
(2) Date: Feb. 25, 2020

(87) PCT Pub. No.: WO2019/038752
PCT Pub. Date: Feb. 28, 2019

(65) Prior Publication Data

US 2020/0385918 A1 Dec. 10, 2020

Related U.S. Application Data

(60) Provisional application No. 62/549,976, filed on Aug. 25, 2017.

(51) Int. Cl.
*D06F 89/00* (2006.01)

(52) U.S. Cl.
CPC ..... *D06F 89/00* (2013.01)

(58) Field of Classification Search
CPC ..... G06F 89/00; G06F 89/02; G06F 89/023
See application file for complete search history.

(56) References Cited

U.S. PATENT DOCUMENTS 3,339,914 A * 9/1967 Grantham ..... D06F 89/00 493/23
3,347,334 A * 10/1967 Schroeder ..... B60R 16/04 180/68.5

(Continued)

FOREIGN PATENT DOCUMENTS

EP 0677610 A2 10/1995
GB 1058846 A 2/1967

(Continued)

OTHER PUBLICATIONS

Int'l. Search Report for PCT/IL2018/050887, dated Nov. 6, 2018.

*Primary Examiner* — Ismael Izaguirre
(74) *Attorney, Agent, or Firm* — Blue Filament Law PLLC

(57) ABSTRACT

A domestic compact article folding machine (10) configured for autonomous article folding includes first, second and third primary conveyors (CI, C2, C3), at least two of which in a stacked formation, each includes two primary rollers (32) and a primary belt (34) which extends thereabout. First and second holding conveyors (U1, U2), each includes at least three holding rollers (32) and a holding belt (34) which extends thereabout. Each of the holding conveyors engages each of the first and second primary conveyors respectively. The folding machine further includes at least a first width-folder (38) which is configured for creating a width-fold in the article and at least a first length-folder (64) which is configured for creating a length-fold in the article.

20 Claims, 6 Drawing Sheets

(56) References Cited

U.S. PATENT DOCUMENTS

| | | | | | |
|---|---|---|---|---|---|
| 3,680,852 | A | * | 8/1972 | Kamberg | D06F 89/00 493/418 |
| 3,702,696 | A | * | 11/1972 | Teed | D06F 89/00 493/10 |
| 4,093,205 | A | * | 6/1978 | Kober | B65H 45/04 493/425 |
| 5,540,647 | A | * | 7/1996 | Weiermann | D06F 89/00 493/444 |

FOREIGN PATENT DOCUMENTS

| | | | |
|---|---|---|---|
| GB | 1083101 | A | 9/1967 |
| JP | 2013-252295 | A | 12/2013 |

* cited by examiner

DOMESTIC COMPACT ARTICLE FOLDING MACHINE HAVING HOLDING CONVEYORS AND FOLDING METHOD THEREFOR

FIELD OF THE INVENTION

The subject matter of the current application relates to affordable compact garment/fabrics folding machines. Specifically, it relates to washing-machine-sized folding machines configured for domestic, or non-industrial use. The current application does not relate to folding machines configured for folding large items such as bed sheets, jackets, coats and overalls, and small items such as socks or underwear.

BACKGROUND OF THE INVENTION

There has been a long-felt need in the domestic consumer market for a compact, affordable product which can quickly and reliably fold laundry. Folding machines of the field are known and disclosed, for example, in U.S. Pat. No. 8,973,792. One of the main goals according to the subject matter of the application is producing a household folding machine, the outer dimensions of which being similar to outer dimensions of standard-sized washing machines or driers. Another important goal is to produce such a folding machine which is affordable to the average consumer.

SUMMARY OF THE INVENTION

In accordance with a first aspect according to the subject matter of the present application there is provided a domestic compact article folding machine configured for autonomous article folding and comprising:

first, second and third primary conveyors, at least two of which being in a stacked formation, each comprising two primary rollers and a primary belt extending thereabout;

first and second holding conveyors, each comprising at least three holding rollers and a holding belt extending thereabout, each of the holding conveyors being in engagement with each of the first and second primary conveyors respectively;

at least a first width-folder being configured for creating a width-fold in the article; and at least a first length-folder being configured for creating a length-fold in the article.

In accordance with a second aspect according to the subject matter of the present application there is provided an article folding method comprising the following steps:

receiving an article from the user with an article front facing the user or upwards in the vertical direction;

folding a first width-fold;

first reversing of the article in the longitudinal direction;

folding the article a second width-fold;

second reversing of the article in the longitudinal direction;

third reversing of the article in the longitudinal direction;

folding a first length-fold;

folding a second length-fold;

flattening the article; and unloading the article.

In accordance with a third aspect according to the subject matter of the present application there is provided an article folding method comprising the following steps:

receiving an article from the user with an article front facing the user or upwards in the vertical direction;

folding a first width-fold;

folding the article a second width-fold;

first reversing of the article in the longitudinal direction;

second reversing of the article in the longitudinal direction;

folding a first length-fold;

folding a second length-fold; and unloading the article.

In accordance with a fourth aspect according to the subject matter of the present application there is provided a domestic compact article folding machine configured for autonomous article folding and comprising:

first, second, third and fourth primary conveyors, at least two of which being in a stacked formation, each comprising two primary rollers and a primary belt extending thereabout;

first second and third holding conveyors, each comprising at least three holding rollers and a holding belt extending thereabout, each of the holding conveyors being in engagement with each of the first and second primary conveyors respectively;

first and second width-folders each being configured for creating a width-fold in the article; and first and second length-folders each being configured for creating a length-fold in the article.

Any of the following features, either alone or in combination, may be applicable to any of the above aspects of the subject matter of the application:

The folding machine only includes a single first width-folder and only a single first length-folder.

The folding machine can further include a second width-folder being configured for creating a width-fold in the article.

The folding machine can further include a second length-folder being configured for creating a length-fold in the article.

The engagement between each primary and holding conveyor is configured for pulling, reversing and reducing thickness of articles.

The first width-folder is arranged, and configured to fold articles located, at the first primary conveyor.

The second width-folder is arranged, and configured to fold articles located, at the second primary conveyor.

The first and second width-folders are both arranged, and configured to fold articles located, at the first primary conveyor.

The first length-folder is arranged, and configured to fold articles located, between the third primary conveyor and the second holding conveyor.

The first length-folder is arranged, and configured to fold articles located, between the fourth primary conveyor and the third holding conveyor.

The first width folder includes width adjustable female and male members configured to passively fold excess fabric in a lateral direction as the article is being pulled thereacross in the longitudinal direction.

The second width folder includes folding arms configured to throw and fold excess fabric in a lateral direction as the article is being conveyed in the longitudinal direction.

In a vertical direction, at least portions of each holding conveyor is located both above and under an associated primary conveyor.

At least a portion of exactly one roller of each primary conveyor is located between two holding rollers of each associated holding conveyor, and the primary belt engages the holding belt and holds it inwards, towards the third roller of the same holding conveyor.

Each primary conveyor can have an independent relationship with any other primary conveyor.

The folding machine can be configured to accommodate and fold at least two articles simultaneously.

In a view in a vertical direction, each pair of adjacent primary conveyors have at least 50 percent overlap therebetween.

The article is length-folded for the first time between a primary conveyor and a moving receiving surface located therebeneath.

The folding machine can have a box-shaped enclosure which includes machine top and bottom surfaces and a machine peripheral surface which extends therebetween; and in an operative mode, a loading system protrudes outwardly from the machine peripheral surface.

The loading system includes an active hanger assembly which is adjustable in width and configured to receive various article sizes from a machine user.

The loading system is adjustable in a lateral direction and configured to receive and accommodate various article sizes.

Bed sheets, socks, jackets, coats, overalls and underwear are not supported by the folding machine.

The folding machine is not configured to fold articles longer than 150 cm.

The folding machine is not configured to fold articles fabrics thicker than 11 millimeters.

An unloading system is located always on the same side of folding machine as the loading system.

The loading system is retractable, and folds inside the machine in a non-operative, or folded mode.

The unloading system comprises a conveyor or other means which moves back and forth in the longitudinal direction and configured for stacking articles by being in semi-independent relationship with a primary conveyor located thereabove.

The folding machine includes sensors configured for detecting existence, width and/or thickness and/or length of articles.

The folding machine can further include article handling or treatment mechanisms.

The folding machine can include a fabric softening arrangement and/or a fragrance arrangement.

An article folding method using the folding machine can include the following steps:

receiving an article from the user into the active hanger with an article back facing the folding machine and an article front facing the user or upwards in the vertical direction;

pulling the article using the active hanger via the first width-folder and performing a first width-fold;

pulling the article using the hanger onto the first primary conveyor;

conveying the article and reversing it between the first holding conveyor and the first primary conveyor and onto the second primary conveyor.

performing the second width-fold using the second width-folder.

conveying the article and reversing it between the second holding conveyor and the second primary conveyor and onto the third primary conveyor;

conveying the article and reversing it between the third holding conveyor and the third primary conveyor and at least partially conveying the article onto the active fourth primary conveyor;

folding the first length-fold by conveying the article, at least partially, through a folding space between the third holding conveyor and the fourth primary conveyor and onto the fifth primary conveyor moving in a first direction;

folding the second length-fold by conveying the article in a direction opposite the first direction;

flattening the article by conveying it between the fourth and fifth primary conveyors; and conveying the article to the unloading system.

An article folding method using the folding machine can include the following steps:

receiving an article from the user into the active hanger with an article back facing the folding machine and an article front facing the user or upwards in the vertical direction;

pulling the article using the active hanger via the first width-folder and performing a first width-fold;

pulling the article using the active hanger onto the first primary conveyor;

performing the second width-fold using the second width-folder;

conveying the article and reversing it between the first holding conveyor and the first primary conveyor and onto the second primary conveyor;

conveying the article and reversing it between the second holding conveyor and the second primary conveyor and at least partially conveying the article onto the active third primary conveyor;

folding the first length-fold by conveying the article, at least partially, through the folding space between the second holding conveyor and the third primary conveyor and onto the fourth primary conveyor rotating in a first direction;

folding the second length-fold by conveying the article in a direction opposite the first direction via the fourth primary conveyor; and conveying the article to an unloading system.

BRIEF DESCRIPTION OF THE DRAWINGS

For a better understanding of the subject matter of the present application and to show how the same may be carried out in practice, reference will now be made to the accompanying drawings, in which.

Figure 1:
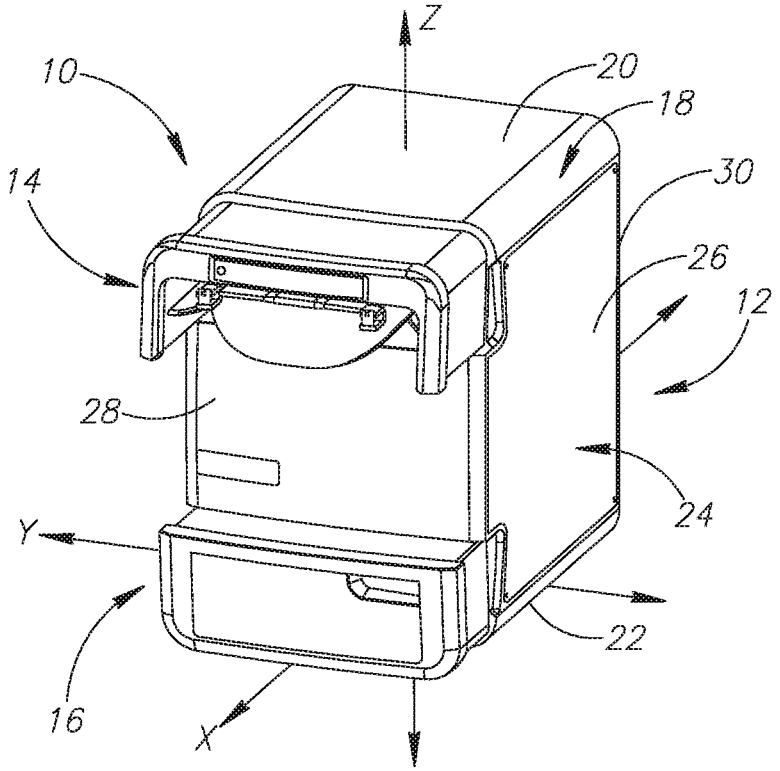
FIG. 1 is an isometric external view of a first embodiment of a folding machine in an operative mode.

Where considered appropriate, reference numerals may be repeated among the figures to indicate corresponding or analogous elements.

DETAILED DESCRIPTION OF THE INVENTION

In the following description, various aspects of the subject matter of the present application will be described. For purposes of explanation, specific configurations and details are set forth in sufficient detail to provide a thorough understanding of the subject matter of the present application. However, it will also be apparent to one skilled in the art that the subject matter of the present application can be practiced without some specific configurations and details presented herein.

Figure 2:
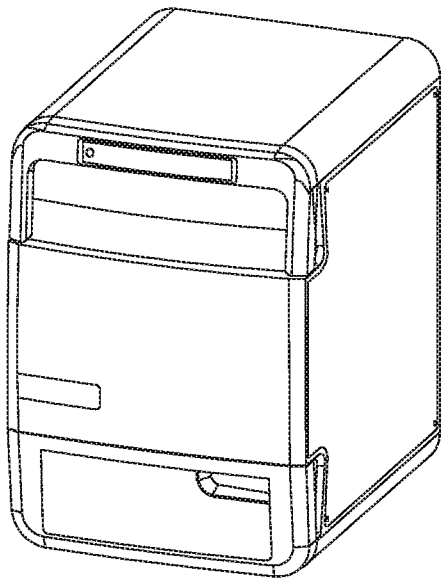
FIG. 2 is an isometric external view of the folding machine of FIG. 1 in a non-operative mode.

Reference is made to FIGS. 1 and 2. A compact folding machine 10 has machine top and bottom ends and a uniform machine body 12 which extends therebetween. In a non-operative, or storage, mode all the sub-systems of the folding machine 10 are preferably located inside an enclosure 18. The machine top end has a loading system 14 which can protrude outwardly therefrom and the machine bottom end has an unloading system 16 which can protrude as well. Both the loading and unloading systems 14, 16 are located on the same side, or peripheral area of the folding machine 10.

Articles are fed into the folding machine 10 via the loading system 14, and exit the folding machine 10 folded from the unloading system 16. The folding machine 10 can fold articles in the lateral direction and/or in the longitudinal direction anywhere along a folding path starting at the loading system 14 and ending at the unloading system 16. A fold in the lateral direction of the folding machine 10 will be referred to herein as a width-fold. A fold in the longitudinal direction of the folding machine 10 will be referred to herein as a length-fold. According to the present embodiments, the folding machine 10 is capable of at least one width-fold and/or at least one length-fold in accordance with the application (i.e., type of article, type and/or amount of folds). The folding machine 10 can receive and fold and/or treat multiple articles simultaneously as seen in FIGS. 7-20.

The enclosure 18 has machine top and bottom surfaces 20, 22 and a machine peripheral surface 24 which extends there between. The machine peripheral surface 24 can have opposite machine side surfaces 26 and opposite machine front and rear surfaces 28, 30 which extend between the machine side surfaces 26. The enclosure 18 can include at least one service door.

The folding machine 10, and specifically the maximum dimensions of the outer enclosure 18, are preferably less than 65 centimeters in width; 95 centimeters in height and 75 centimeters in depth.

The machine bottom surface 22 can be planar and defines a vertical axis Z which is perpendicular thereto and extends from a middle of the machine bottom surface 22 and passes through the machine top surface 20. Alternatively, a base virtual plane which passes through base points or legs of the machine can define the vertical axis Z. A longitudinal axis X extends perpendicular to the vertical axis Z, lays in the machine bottom surface 22 or the base virtual plane and passes through the machine front and rear surfaces 28, 30. The longitudinal axis X extends midway between the machine side surfaces 26. A lateral axis Y extends perpendicular to the longitudinal axis X and to the vertical axis Z and lays in the machine bottom surface 22. The vertical axis Z defines a vertical direction parallel thereto. The longitudinal axis X defines a longitudinal direction parallel thereto. The lateral axis Y defines a lateral direction parallel thereto.

Figure 3:
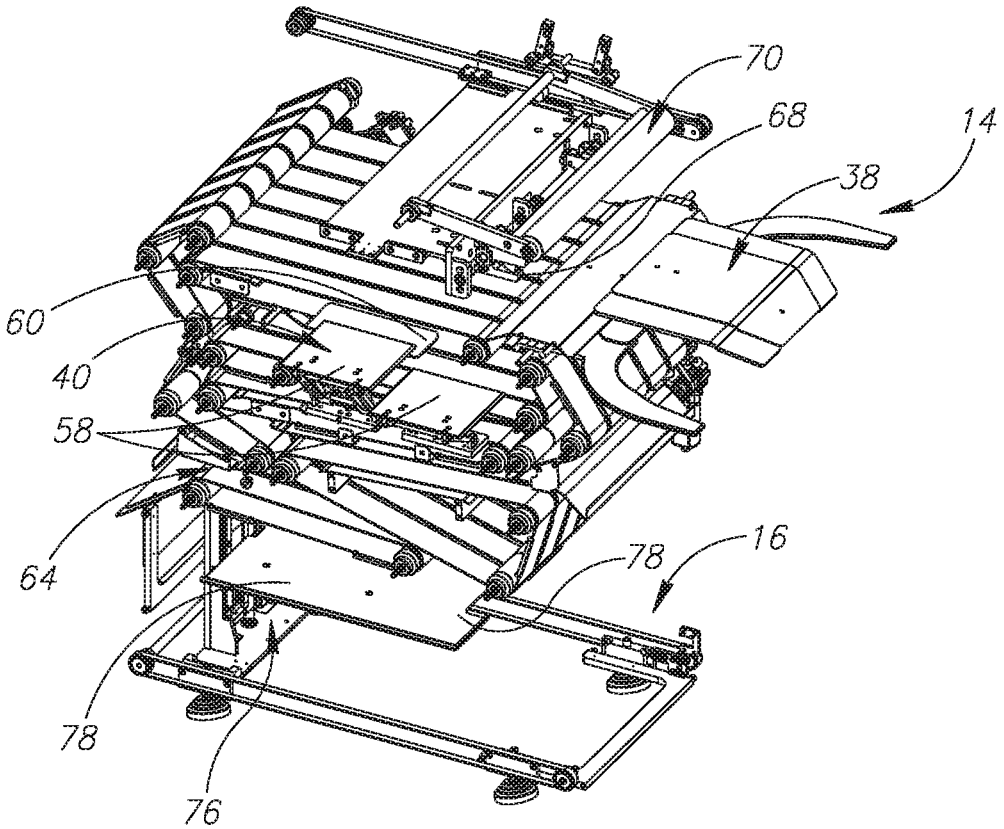
FIG. 3 is a schematic internal isometric view of the folding machine of FIG. 1 with its enclosure removed.
Figure 4:
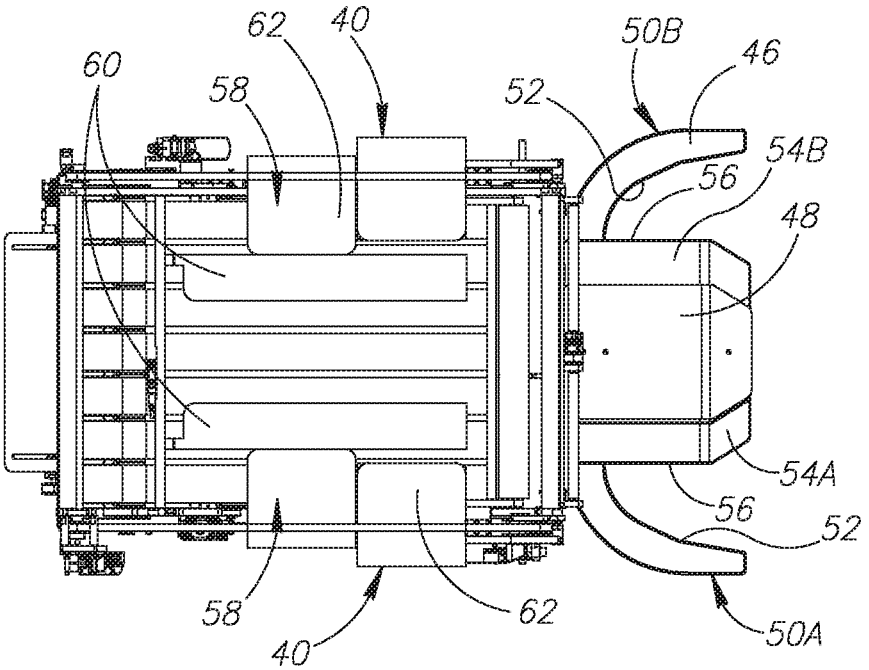
FIG. 4 is a top plan view of a second width-folder in a top, plan view of an associated primary conveyor.

Attention is drawn to FIG. 3. As will be further explained, the folding machine 10 includes at least stacked conveyors configured to convey, fold and stack articles. The word conveyor is used herein in the classical sense, which means that a conveyor according to the subject matter of the present application includes at least two pulleys/rollers 32 and one or more belts 34 stretched thereabout. The belts 34, are preferably elastic, i.e., stretchable. The word stacked is used to describe a structure in which adjacent conveyors at least partially overlap in a top-to-bottom/plan view thereof (as seen in FIG. 4). In other words, each conveyor is located either under, or above, an adjacent conveyor.

According to preferred embodiments, the overlap spans across at least 50 percent of a footprint, or area of the conveyor in a plan view thereof. In some embodiments, the overlap spans across at least 70 percent of the conveyors footprint. This overlap is advantageous since it directly contributes to a more compact design, and as small as possible machine footprint at least in the longitudinal or horizontal direction. In other words, for example—shorter conveyors will lead to a smaller longitudinal footprint of the folding machine 10, but can possibly lead to additional layers/floors of conveyors such that the folding machine 10 can accommodate the same article length, and/or number of simultaneous articles. As will further be explained in detail below, the number of stacked conveyors can directly affect the types and amount of folds and/or article turns that the machine is capable of performing.

According to a first embodiment, the folding machine 10 can include five stacked static primary conveyors C—first, second, third and fifth non-active/static, primary conveyors C1, C2, C3, C5; an active forth primary conveyor C4 and at least three holding conveyors U—first, second and third holding conveyors U1, U2, U3.

Each static (has a fixed position and orientation, i.e., it is not movable) primary conveyor C can include at least two primary rollers 32 and seven primary belts 34 stretched thereabout. Each primary conveyor C has a primary length PL which is defined as the maximum dimension of the primary conveyor in a direction perpendicular to parallel rotation axes of the rollers 32. The primary length PL can range between 350 mm and 550 mm. These optimized dimension ranges (discovered as a result of rigorous research and development) were found to directly affect the compactness of the folding machine 10. In other words, these ranges represent a balance between a minimal number or conveyors or layers/floors of conveyors in the vertical direction, and a minimal depth of the folding machine 10, which is still capable of operating properly, i.e., achieving desired number of folds, fold-types, fold-quality, speed and reliability. As will be further explained below, the fourth primary conveyor C4 is active, in the sense that it is movable (in its entirety, i.e., the distance between primary rollers 32 is maintained) in a direction towards, and from the third holding conveyor U3. The only active conveyor in the folding machine 10 according to the first embodiment is the fourth primary conveyor C4.

Figure 5:
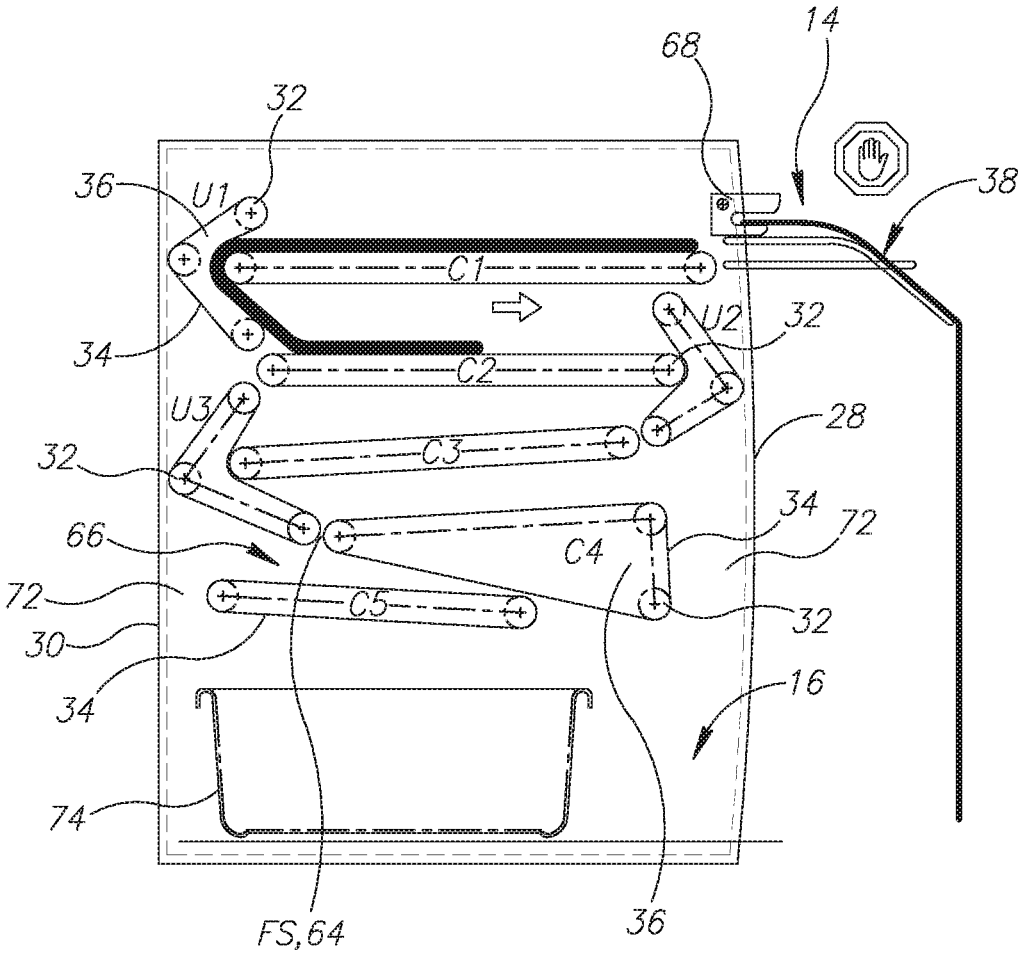
FIG. 5 is a schematic internal side view of the folding machine of FIG. 1.
Figure 6:
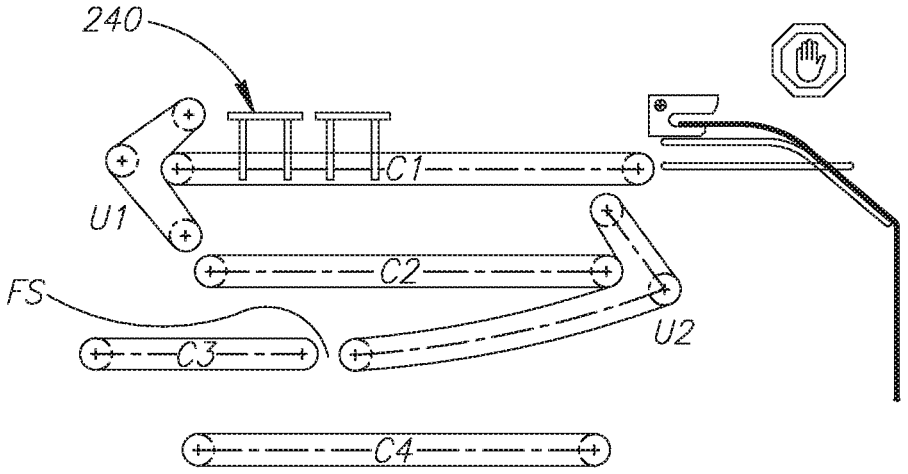
FIG. 6 is a schematic internal side view of a second embodiment of the folding machine in an operative mode.
Figure 7:
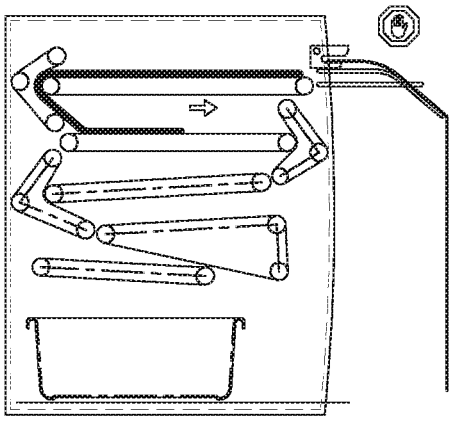
FIGS. 7-20 are schematic internal side views of the folding machine of FIG. 1 in different stages of a first embodiment of a folding method.
Figure 10:
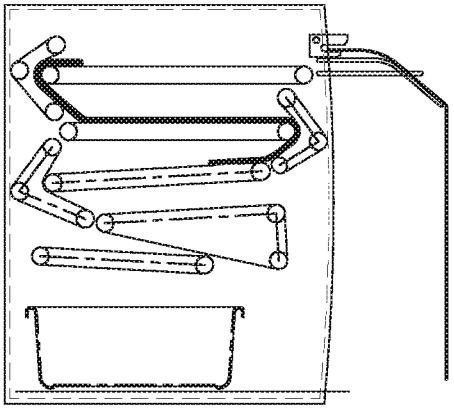

Attention is drawn to FIG. 5. According to the current embodiments, each holding conveyor U includes exactly three holding rollers 32 and seven holding belts 34 stretched thereabout. Each holding conveyor U has a triangular shape in a side view thereof, which creates room, or internal space 36 for the belts to stretch inwards between the holding rollers 32 as will be further disclosed below.

Attention is drawn to FIG. 5. According to the first embodiment, the first primary conveyor C1 (specifically its primary belts 34) is oriented generally in the longitudinal direction. The primary conveyor C1, and specifically one primary roller 32 thereof, is located at least partially between two holding rollers 32 of the first holding conveyor U1 and pushes (and stretches) the belts 34 of the first holding conveyor U1 inwards into the internal space 36 thereof. This engagement is identical to all three associated pair of primary and holding conveyors respectively, i.e., C1+U1; C2+U2 and C3+U3. This engagement between each pair of primary and holding conveyors ensures that the article is reliably pulled to the next stage in the folding machine 10, thoroughly pressed (or thinned) and also reversed/flipped in a single pass therebetween. The second primary conveyor C2 is located directly under (100% overlap in the longitudinal and lateral directions) the first primary conveyor C1, and adjacent the first holding conveyor U1 in the longitudinal direction. The third primary conveyor C3 is located directly under (at least 80% overlap in the longitudinal and lateral directions) the second primary conveyor C2, and adjacent the second holding conveyor U2 in the longitudinal direction. The active fourth primary conveyor C4 is located directly under (at least 80% overlap in the longitudinal and lateral directions) the third primary conveyor C3, and adjacent the third holding conveyor U3 in the longitudinal direction with the folding space FS located therebetween. The fifth primary conveyor C5 is located directly under the folding space FS.

The active fourth primary conveyor C4 can include a third roller 32, which is not located between the other two rollers. From a side or cross-section view, it can be seen that the third roller 32 divides the belts into three portions. The additional third roller 32 enables the active fourth primary conveyor C4 to extend the three portions of the belts 34 far from each other such that an internal space 36 is created (no belt portion is parallel to another portion). The internal space 36 and triangular geometry allows the elastic belts 34 to extend, or stretch inwardly when a thick article is conveyed between the fourth and fifth primary conveyors C4, C5.

According to the present application three types of 'relationships' or 'correlations' between conveyors are defined—Dependent, Semi-dependent and Independent conveyors. (a) Dependent conveyors are defined as having at least one shared roller 32 and/or a shared belt 34 334. (b) Semi-dependent conveyors are defined as not sharing any physical features, and as being synchronized. In other words, semi-dependent conveyors can rotate simultaneously, or separately, at the same, or different (but synchronized) speed, in either the same or opposite direction/s. (c) Independent conveyors are defined as being completely independent either physically (nothing shared), and/or in terms of rotation speed or direction.

For example, according to the first embodiment, the first primary conveyor C1 and the first holding conveyor U1 are semi-dependent, and are always in sync, i.e., rotating simultaneously, in opposite directions and at the same speed. Specifically, they can be driven by a single driving motor. Another example—the first holding conveyor U1 and the second primary conveyor C2 are independent. This relationship enables the folding machine 10 to hold a first article, while another, second article is being folded further along the folding path.

According to the current embodiments, and as will be disclosed in detail below, the machine can include a passive, or semi-passive first width-folder 38 and an active second width-folder 40. Furthermore, the folding machine 10 can include two active length-folders 64, 66.

Attention is drawn to FIGS. 3-6. The first width-folder 38 is configured to fold excess fabric at sides of the article, such as sleeves. The first width-folder 38 is a passive, or semi-passive mechanism, in the sense that it is stationary, and does not actively move the fabric to fold it, but rather the fabric is being pulled thereacross, to create a fold. According to the present embodiment, the first width-folder 38 includes a female member 46 and a corresponding male member 48 which is located thereabove in the vertical direction.

The female member 46 includes right and left female extensions 50A, 50B and always includes an opening therebetween. Each of the right and left female extensions 50A, 50B includes an internal first folding edge 52. The two first folding edges 52 are located opposite of each other and converge in the longitudinal direction inwards, towards the machine rear surface 30.

The male member 48 can include a trapezoidal protrusion and right and left male extensions 54A, 54B, each of which includes a second folding edge 56, both converging in the longitudinal direction, outwardly, away from the machine rear surface 30. The male member 48 preferably includes a bend (forming a downwards-facing concavity in the male member 48) such that it extends downwards after the bend.

In a plan view of the first width-folder 38, the two second folding edges 56 are located between the two first folding edges 52 (transversely thereto) such that when an article is pulled across the male member 48 (towards the machine rear surface 30), a mid-portion thereof climbs onto the male member 48 and any excess fabric at its sides is urged, or folded (a fold is created at the second folding edges 56), inwards by the first folding edges 52, beneath the male member 48. Therefore, the excess fabric is folded in the lateral direction by the loading system 14.

The first width-folder 38 can automatically (value entered by the user prior to loading the article) and/or autonomously (i.e., depending on sensor input) adjust in the lateral direction to accommodate different article widths. The first width-folder 38 can change a distance (in the lateral direction) between the right male and female extensions 50A, 54A and the left male and female extensions 50B, 54A, using, e.g., a rail mechanism.

Attention is drawn to FIGS. 3-4. The second width-folder 40 can include two or more motorized mechanical folding arms 58. The second width-folder 40 folds the article further in its width, which narrows the article in the lateral direction. According to the first embodiment, the second width-folder 40 includes two pairs of folding arms 58, each pair located on opposite sides of the second primary conveyor C2 (in the lateral direction). Therefore, the second primary conveyor C2 becomes narrower (i.e., seven belts 34 become five belts 34) in the lateral direction, right before the second width-folder 40. Specifically, the second primary conveyor C2 can include seven belts 34 connected to a first primary roller adjacent the first holding conveyor U1 (left hand side of FIG. 4), five belts 34 connected to a second primary roller adjacent the third holding conveyor U3 (right hand side of FIG. 4), and a third primary roller 32 which connects the two sets of belts 34 which is located between said first and second primary rollers 32 located at opposite ends of the second primary conveyor C2. Each pair of folding arms 58 is configured to lift and throw and create a width-fold in the lateral direction for article extremities.

The second-width folder 40 can include ski-shaped panels 60 which are configured to hold the fabric, press it against the second primary conveyor C2 to allow the folding arms 58 to fold only the necessary portion of the fabric. The panels 60 are configured to locate, or create, two width-folds, or folding lines in each article. The panels 60 are configured to self-adjust at least in the lateral direction. In other words, a distance between the panels 60 can be altered according to folding parameters. This adjustment therefore affects the distance between the two width folds created by the second width-folder 40. The folding arms 58 are preferably synchronized to prevent different fabric portions from hitting each other in case they are too long and can overlap. Another advantage stemming from two folding arms 58 working in the same volume is to save valuable space in the lateral direction. In other words, the arms can have an overlapping relationship without engagement. The folding arms 58 can work in the lateral direction while the article is simultaneously being conveyed in the longitudinal direction. The folding arms 58 can include a planar folding surface 62 which engages the articles and always faces upwards.

Attention is drawn to FIG. 5. A first length-folder 64 includes the third holding conveyor U3 and the active fourth primary conveyor C4 which are arranged one after the other, or 'in-line', in the longitudinal direction and define a folding space FS therebetween. The third holding conveyor U3 is static, or fixed within the folding machine 10, and the fourth primary conveyor C4 is movable, in its entirety, in the longitudinal direction. The fourth primary conveyor C4 can be mounted on a rail which enables back and forth movement. The folding space FS is therefore adjustable depending on the thickness of article being folded. In the current embodiment, this adjustment is achieved via a spring which always forces the fourth primary conveyor C4 towards the third holding conveyor U3 (to minimize the folding space FS), and a motorized arrangement which actively moves the fourth primary conveyor C4 in the opposite direction, away from the third holding conveyor U3. In a position when the article lies on top of both conveyors, rotation of the conveyors in opposite directions pulls the article into the folding space FS—creating the first length-fold, or length-crease in the fabric. The folding space FS can range between 2 mm and 60 mm. The first length-fold is performed while the two conveyors rotate in opposite directions, towards each other (i.e., always a top half of each conveyor band), pulling, or forcing (via friction) the article through the folding space FS which is configured to self-adjust (via the spring), thereby allowing the article to flow therethrough. It is noted that a fold apex is determined at a specific location in the article which was located directly above the folding space FS before the conveyors began to rotate in opposite directions towards each other (e.g., the third holding conveyor U3 rotates clockwise, and the fourth primary conveyor C4 rotates counter clockwise).

A second length-folder 66 can be located immediately after the first length-folder 64. The second length-folder 66 can include at least one of the fourth primary conveyor C4 and the third holding conveyor U3, and can include the fifth primary conveyor C5. In fact, as will be explained below, any two stacked independent conveyors can be utilized/configured in order to achieve the second length-fold. The second length-folder 66 is analogous to honey-pouring, due to some resemblance. In the second length-folder 66, the article can be conveyed (according to the present embodiment, via the folding space FS of the first length-folder 64), gradually, onto the fifth primary conveyor C5 (or equivalent means) located underneath the folding space FS. During the second width-fold, the fifth primary conveyor C5 is temporarily synchronized with the third holding conveyor U3 and the fifth primary conveyor C5, and consequently, with the movement speed of the article, or 'pouring speed'. When the article partially lies on the fifth primary conveyor C5, and the rest is hanging from the folding space FS, the fifth primary conveyor C5 changes its rotation direction, thereby defining the fold, or crease, line of the article.

The loading system 14 can include a single active hanger 68 and a first primary conveyor C1. The loading system 14 further includes the first width-folder 38, which is located farthest from the folding machine rear surface 30 at a loading system 14 front end.

The loading system 14 can include a roller-press 70 which is configured for pulling, pressing and flattening the article after being first-folded and pulled onto the first primary conveyor C1 by the active hanger 68. The roller-press 70 serves as an active pulling mechanism, or pulling-aid, which is essential with relatively long and/or heavy/dense articles. The roller-press 70 is configured for pulling articles which are too long and extend beyond, and outside the primary conveyor C1 by increasing friction with respect to the holding belt. The roller-press 70 is helpful in some cases where the weight of a portion of the article extends outside the primary conveyor C1 pulls the article with a force which exceeds the friction force between the article and the primary conveyor C1. The roller-press 70 is configured to actively pull and bring the article into the first pair of first primary and holding conveyors C1, U1 between which the article is pulled, pressed and reversed.

The loading system 14 is preferably at least partially retractable, i.e., it can be drawn in, or fold inside the enclosure 18 when not in use i.e., in the non-operative mode. In the operative mode, the loading system 14 extends, or the majority of which, is located outwardly, or externally to the enclosure 18. In the present embodiment, the male and female members 48, 46 and the active hanger 68 can extend outwardly from the enclosure 18. This is advantageous, since it becomes easier to hand over the articles to the folding machine 10 when the loading system 14 extends outwardly from the machine, being more accessible to the user. Furthermore, the outwards extension is advantageous for folding, since it allows most of the fabric to hang, or be pulled downwards by gravity, thereby stretching and loosening any existing folds or twists in the fabric. This structure is not advantageous only in terms of user ergonomics, but also because it was found preferable (less weight is pulling the article away from the loading system 14/the active hanger) that a minimum portion of the article is hanging in the vertical direction before entering the loading system 14, or specifically, into the first width-folder.

According to the present example, the active hanger 68 includes a hanger rail which extends in the longitudinal direction and motorized band, or chain, onto which a single hanger is attached. The hanger 68 extends in the lateral direction and can include two passive or active clips configured for releasably clamping the fabric. According to the present example, each clip is passive and includes a static jaw and a resilient clamping arm which elastically folds (or lifts) inwards when the fabric is inserted into the clip, and elastically clamps the fabric onto the static jaw such that when the hanger is moved, it carries, or pulls, the article. At an inwardly located release portion, the hanger rail can include a release arm, or an equivalent mechanism, which forces and lifts the clamping arms enabling a release of the fabric at a desired location onto the conveyor thereunder.

In the vertical direction, the first width-folder is preferably located between the first primary conveyor C1 and the active hanger (and therefore easily retractable therebetween). In the longitudinal direction, the first width-folder is located further outwardly than the first primary conveyor C1 in the operative mode. In the non-operative mode, in the longitudinal direction, the first width-folder overlaps the first primary conveyor C1 and the active hanger.

The folding machine 10 can fold articles with a preferred range of fabric thickness of less than 11 millimeters. Furthermore, the folding machine (10) is not configured to fold articles longer than 150 cm.

The folding machine 10 includes sensors across the various folding path inside the folding machine 10. According to the present example, electro-optic, or specifically, photo-electric sensors are used to detect the existence of articles and to measure lengths thereof.

A designated surplus space 72, or volume, is defined between the conveyors and the enclosure 18 in the longitudinal direction, which enables the folding machine 10 to accommodate and handle long, or longer articles which, e.g., are longer than the primary length PL. The surplus space 70 is advantageous since it allows to preserve the compactness of the folding machine 10 while still accommodating long articles. In the first embodiment, surplus spaces are located internally inside the enclosure 18 between the fourth primary conveyor C4 and the machine front surface 28, and between the fifth primary conveyor C5 and the machine rear surface 30.

The unloading system 16 is always located on the same side of folding machine 10 as the loading system 14, can be retractable, and can include some form, or combination between a basket 74 and a lifting arrangement 76. The basic principle is that the lifting arrangement 76 includes a motorized lift base surface 78 which can move in the vertical and longitudinal directions. The unloading system 16 can be utilized to receive folded articles and/or assist with the second length-folder 66 (similar to the fifth primary conveyor C5 in the second length-folder 66) and finally, the unlading system 16 can also press folded articles to increase fold quality (push the folded articles upwards against a flat surface, i.e., the fifth primary conveyor C5).

In some embodiments, the basket 78 can be clamped, or releasably attached onto a lifting arrangement 76, which can include a basket base surface 78 which can move upwards/downwards in the vertical direction. The lifting arrangement 76 (e.g., a jack) can be secured onto a conveyor, or onto rails to allow the motion in the longitudinal direction.

In other embodiments, the unloading system 16 can include a lifting arrangement 76 located under a foldable/flexible basket 74, and a passive basket 74 which can be unclamped/pulled outwardly from the folding machine 10 once the lifting arrangement 76 finished unloading the articles.

The folding machine 10 can also include article treatment systems. The term can refer to spraying of chemicals such, e.g., perfume but also to physical manipulation such as pressing of the fabric.

A first type of fabric treatment system can be a De-wrinkling system which can include spraying softener and/or a preferably heated roller-press as depicted in FIG. 3. The De-wrinkling treatment is preferably located at approximately the middle of the article folding process, i.e., at the loading system 14.

A second type of fabric treatment system can be a spraying system which sprays sterilizer and/or fragrance onto the fabric. This is likely to take place in the middle and/or the end of the folding path (machine body 12 or unloading system 16). According to some embodiments, the folding machine 10 can include a latterly extending pipe which includes spraying nozzles (connected to fluid or gas conveying channels).

According to the first embodiment, and as illustrated in FIGS. 15-19, in an operative mode, the folding machine 10 can simultaneously accommodate and fold up to three consecutive articles. For example, one article can be held by the active hanger 68 before the first primary conveyor C1, a second article can be located on the second and/or first primary conveyors C1, C2, and a third article can be located on the active conveyor C4 (the already-folded, ready articles are stacked in the basket 74).

According to a second embodiment, an even more compact folding machine 210, which is also capable of performing two width folds and two length folds includes even less components and/or conveyors than the first embodiment of the folding machine 10 as will be herein described. The second embodiment of the folding machine 210 can include only first, second third and fourth primary conveyors C1, C2, C3, C4 and first and second holding conveyors U1, U2 associated respectively with the first and second primary conveyors C1, C2. It is noted that in both the first and second embodiments, the lower-most conveyor which is a part of the unloading system 16 (C5 in the first embodiment, and C4 in the second embodiment) is not an essential for proper operation of the folding machine 10. In other words, any other appropriate holding/moving/conveyance means can be utilized to perform the same function as the lower-most conveyor.

According to the second embodiment, the first width-folder 238, and the loading system 214 can be similar to, or the same as, the corresponding mechanisms 38, 14 of the first embodiment described hereinabove. Contrary to the folding machine 10 of the first embodiment, the second width-folder 240 is located at the first primary conveyor C1, 'in-line', behind the first width-folder 238 when proceeding rearwards in the longitudinal direction. Accordingly, the first primary conveyor C1, includes five belts 34 at the second width folder 240. According to the second embodiment, the folding machine 210 also includes first and second length-folders 264, 266. The first length-folder 264 includes the third primary conveyor C3, the second holding conveyor U2 and the fourth primary conveyor C4. In the second embodiment, the folding space FS is defined between the third primary conveyor C3 and the second holding conveyor U2. The third primary conveyor C3 is therefore an active conveyor.

According to the subject matter of the present application, a first general method of folding articles includes the following steps:

a. Receiving an article from the user with an article front facing the user or upwards in the vertical direction;
b. Folding a first width-fold;
c. First reversing of the article in the longitudinal direction;
d. Folding the article a second width-fold;
e. Second reversing of the article in the longitudinal direction;
f. Third reversing of the article in the longitudinal direction;
g. Folding a first length-fold;
h. Folding a second length-fold;
i. Flattening the article; and
j. Unloading the article.

A second general method of folding articles includes the following steps:

a. Receiving an article from the user with an article front facing the user or upwards in the vertical direction;
b. Folding a first width-fold;
c. Folding the article a second width-fold;
d. First reversing of the article in the longitudinal direction;
e. Second reversing of the article in the longitudinal direction;
f. Folding a first length-fold;
g. Folding a second length-fold; and
h. Unloading the article.

Figure 8:
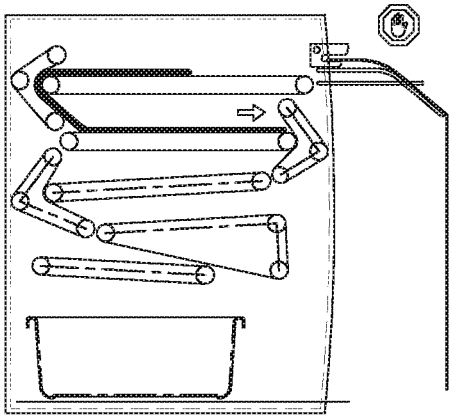
Figure 11:
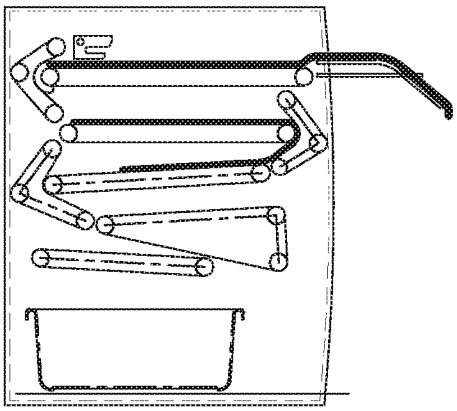
Figure 9:
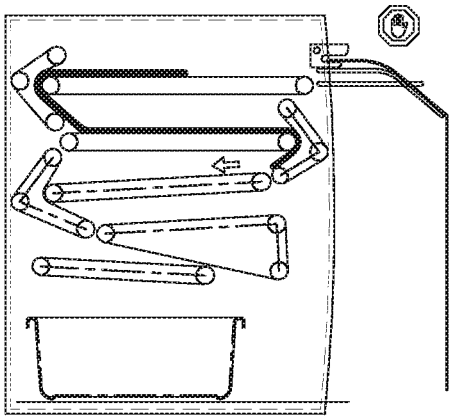
Figure 12:
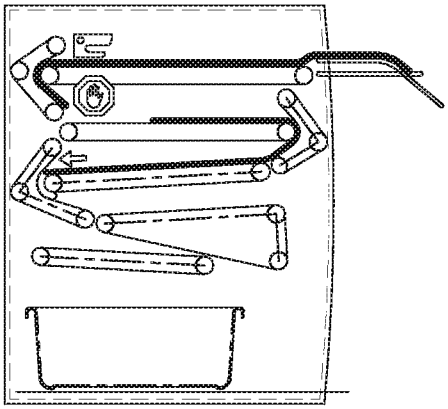
Figure 13:
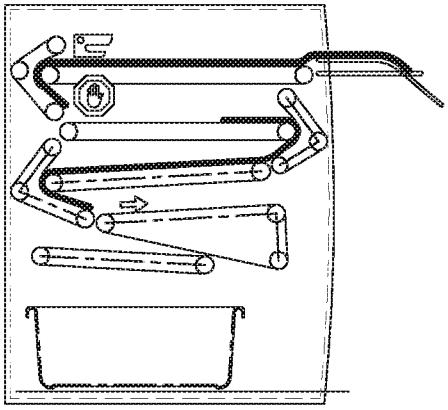
Figure 16:
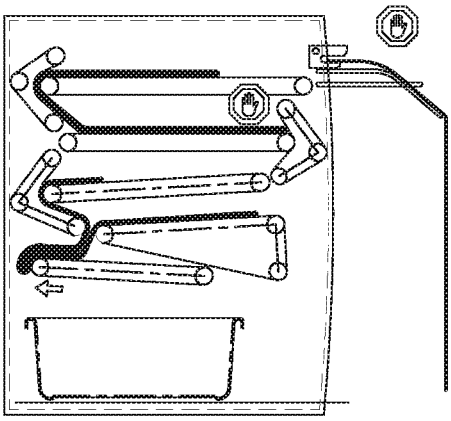
Figure 14:
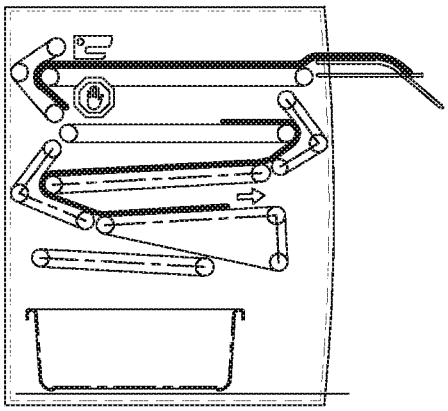
Figure 17:
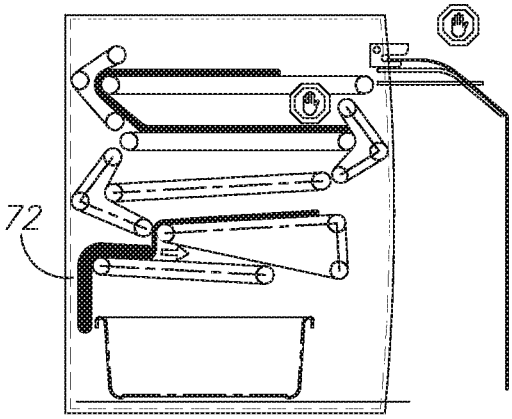
Figure 15:
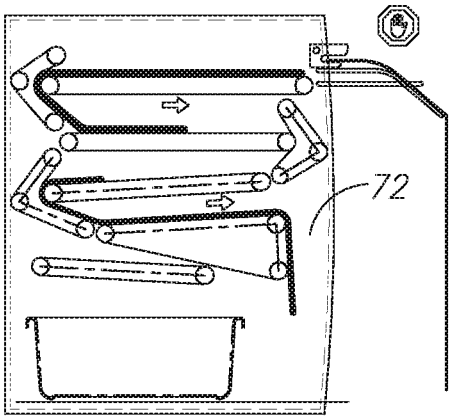
Figure 18:
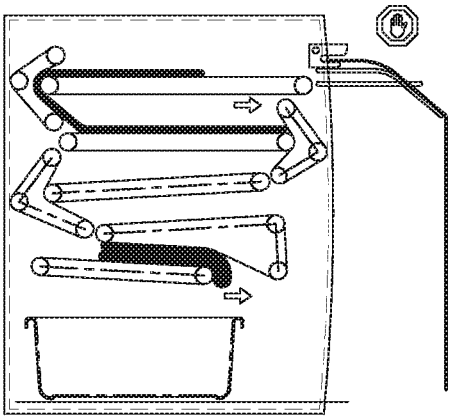
Figure 19:
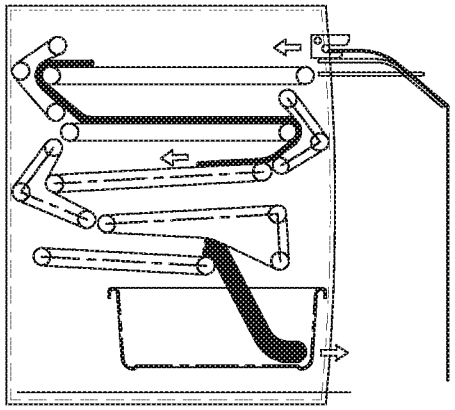
Figure 20:
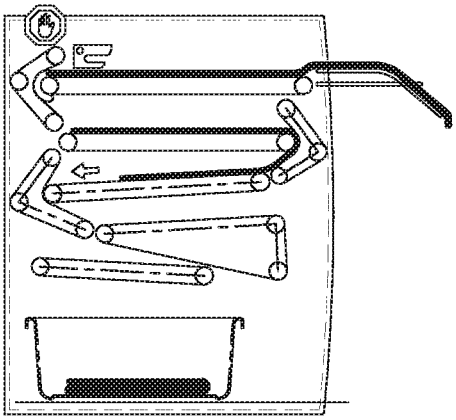

According to the first embodiment, a first specific method of folding articles using the folding machine 10 according to the first embodiment includes the following steps:

a. Receiving an article from the user into the active hanger 68 with an article back facing the folding machine 10 and an article front facing the user or upwards in the vertical direction (FIG. 7, 8);
b. Pulling the article using the active hanger via the first width-folder and performing a first width-fold (FIG. 11);

c. Pulling the article using the hanger and dropping it onto the first primary conveyor (FIG. 11);

d. Conveying the article and reversing it between the first holding conveyor U1 and the first primary conveyor C1 and onto the second primary conveyor C2 (FIG. 8).

e. Performing the second width-fold using the second width-folder (FIG. 8).

f. Conveying the article and reversing it between the second holding conveyor U2 and the second primary conveyor C2 and onto the third primary conveyor C3 (FIG. 9);

g. Conveying the article and reversing it between the third holding conveyor U3 and the third primary conveyor C3 and at least partially conveying the article onto the active fourth primary conveyor C4 (FIG. 13);

h. Folding the first length-fold by conveying the article, at least partially, through the folding space FS between the third holding conveyor U3 and the fourth primary conveyor C4 and onto the fifth primary conveyor C5 moving in a first direction (FIG. 16);

i. Folding the second length-fold by conveying the article in a direction opposite the first direction (FIG. 17-18);

j. Pressing the article by conveying it between the fourth and fifth primary conveyors C4, C5; and (FIG. 18)

k. Conveying the article to the unloading system 16 (FIG. 19-20).

According to the second embodiment, a second specific method of folding articles using the folding machine 210 according to the second embodiment includes the following steps:

a. Receiving an article from the user into the active hanger 268 with an article back facing the folding machine 210 and an article front facing the user or upwards in the vertical direction;

b. Pulling the article using the active hanger 268 via the first width-folder 238 and performing a first width-fold;

c. Pulling the article using the active hanger 268 onto the first primary conveyor C1;

d. Performing the second width-fold using the second width-folder 240;

e. Conveying the article and reversing it between the first holding conveyor U1 and the first primary conveyor C1 and onto the second primary conveyor C2;

f. Conveying the article and reversing it between the second holding conveyor U2 and the second primary conveyor C2 and at least partially conveying the article onto the active third primary conveyor C3;

g. Folding the first length-fold by conveying the article, at least partially, through the folding space FS between the second holding conveyor U2 and the third primary conveyor C3 and onto the fourth primary conveyor C4 rotating in a first direction;

h. Folding the second length-fold by conveying the article in a direction opposite the first direction via the fourth primary conveyor C4; and i. Conveying the article to an unloading system.

The invention claimed is:

1. A domestic compact article folding machine (10, 210) configured for autonomous article folding and comprising:

first, second and third primary conveyors (CI, C2, C3), at least two of which being in a stacked formation, each comprising two primary rollers (32) and a primary belt (34) extending thereabout;

first and second holding conveyors (U1, U2), each comprising at east three holding rollers (32) and a holding belt (34) extending thereabout, each of the holding conveyors (U1, U2) being in engagement with each of the first and second primary conveyors (CI, C2) respectively;

at least a first width-folder (38, 238) being configured for creating a width-fold in the article;

at least a first length-folder (64, 264) being configured for creating a length-fold in the article; and wherein the folding machine (10) further comprises a second width-folder (40, 240) configured for creating a width-fold in the article.

2. The folding machine (10) according to claim 1, wherein the folding machine (10) comprises only a single first width-folder (40) and only a single first length-folder (64).

3. The folding machine (10, 210) according to claim 1, wherein the folding machine (10) further comprises a second length-folder (66, 266) configured for creating a length-fold in the article.

4. The folding machine (10) according to claim 1, wherein said engagement between each primary and holding conveyor (C, U) is configured for pulling, reversing and reducing thickness of articles.

5. The folding machine (10) according to claim 1, wherein the first width-folder (38) is arranged, and configured, to fold articles located at the first primary conveyor (CI).

6. The folding machine (10) according to claim 1, wherein the first length-folder (64) is arranged, and configured, to fold articles located between the third primary conveyor (C3) and the second holding conveyor (U2).

7. The folding machine (10) according to claim 1, wherein the folding machine (10) further comprises a fourth primary conveyor (C4) and a third holding conveyor (U3).

8. The folding machine (10) according to claim 7, wherein the first length-folder (64) is arranged, and configured, to fold articles located between the fourth primary conveyor (C4) and the third holding conveyor (U3).

9. The folding machine (10) according to claim 1, wherein, the first width folder (38) comprises width adjustable female and male members (46, 48) configured to passively fold excess fabric in a lateral direction as the article is being pulled thereacross in the longitudinal direction.

10. The folding machine (10) according to claim 1, wherein, the second width folder (40) comprises folding arms (58) configured to throw and fold excess fabric in a lateral direction as the article is being conveyed in the longitudinal direction.

11. The folding machine (10) according to claim 1, wherein in a vertical direction, at least portions of each holding conveyor are located both above and under an associated primary conveyor.

12. The folding machine (10) according to claim 1, wherein at least a portion of exactly one roller (32) of each primary conveyor is located between two holding rollers (32) of each associated holding conveyor, and the primary belt (34) engages the holding belt (34) and forces it inwards, towards the third roller (32) of the same holding conveyor.

13. The folding machine (10) according to claim 1, wherein in a view in a vertical direction, each pair of adjacent primary conveyors have at least 50 percent overlap therebetween.

14. The folding machine (10) according to claim 1, wherein the article is length-folded for the first time between a primary conveyor and a moving receiving surface located therebeneath.

15. The folding machine (10) according to claim 1, wherein the folding machine (10) has a box-shaped enclosure (18) which comprises machine top and bottom surfaces (20, 22) and a machine peripheral surface (24) which extends therebetween; and in an operative mode, a the loading system (14) protrudes outwardly from the machine peripheral surface (24).

16. The folding machine (10) according to claim 1, wherein the folding machine (10) includes a loading system (14) which comprises an active hanger (68) assembly which is adjustable in width and configured to receive various article sizes from a machine user.

17. The folding machine (10) according to claim 16, wherein an unloading system (16) is located on the same side of folding machine (10) as the loading system (14).

18. The folding machine (10) according to claim 16, wherein the loading system (14) is retractable, and folds inside the machine in a non-operative, or folded mode.

19. The folding machine (10) according to claim 17, wherein the unloading system (16) comprises a conveyor or other means which moves back and forth in the longitudinal direction and configured for stacking articles by being in semi-independent relationship with a primary conveyor located thereabove.

20. An article folding method using a folding machine (210) comprising:

(a) receiving an article from the user into the active hanger (268) with an article back facing the folding machine (210) and an article front facing the user or upwards in the vertical direction;

(b) pulling the article using the active hanger (268) via the first width-folder (238) and performing a first width-fold;

(c) pulling the article using the active hanger (268) and dropping it onto the first primary conveyor (CI);

(d) performing the second width-fold using the second width-folder (240);

(e) conveying the article and reversing it between the first holding conveyor (U1) and the first primary conveyor (CI) and onto the second primary conveyor (C2);

(f) conveying the article and reversing it between the second holding conveyor U2 and the second primary conveyor (C2) and at least partially conveying the article onto the active third primary conveyor (C3);

(g) folding the first length-fold by conveying the article, at least partially, through the folding space (FS) between the second holding conveyor (U2) and the third primary conveyor (C3) and onto the fourth primary conveyor (C4) rotating in a first direction;

(h). folding the second length-fold by conveying the article in a direction opposite the first direction via the fourth primary conveyor (C4); and (i) conveying the article to an unloading system.

* * * * *